US008611574B2

(12) United States Patent
Meier et al.

(10) Patent No.: US 8,611,574 B2
(45) Date of Patent: Dec. 17, 2013

(54) BENDABLE HEARING DEVICE

(75) Inventors: Hans Georg Meier, Uerikon (CH); Richard Niccolai, Uster (CH); Urs Zuger, Stafa (CH)

(73) Assignee: Phonak AG, Stafa (CH)

( * ) Notice: Subject to any disclaimer, the term of this patent is extended or adjusted under 35 U.S.C. 154(b) by 1 day.

(21) Appl. No.: 13/258,528

(22) PCT Filed: May 18, 2009

(86) PCT No.: PCT/EP2009/055965

§ 371 (c)(1),
(2), (4) Date: Sep. 22, 2011

(87) PCT Pub. No.: WO2009/087243

PCT Pub. Date: Jul. 16, 2009

(65) Prior Publication Data

US 2012/0057735 A1 Mar. 8, 2012

(51) Int. Cl.
*H04R 25/00* (2006.01)

(52) U.S. Cl.
USPC ..... 381/322; 381/330

(58) Field of Classification Search
USPC ..... 381/312, 322, 330, 328
See application file for complete search history.

(56) References Cited

U.S. PATENT DOCUMENTS

| | | | | |
|---|---|---|---|---|
| 7,039,208 | B2 * | 5/2006 | Wagner et al. | 381/322 |
| 7,720,244 | B2 * | 5/2010 | Espersen et al. | 381/330 |
| 7,778,434 | B2 * | 8/2010 | Juneau et al. | 381/328 |
| 2003/0044038 | A1 | 3/2003 | Shirata | |
| 2004/0062410 | A1 | 4/2004 | Wagner et al. | |
| 2008/0025541 | A1 * | 1/2008 | Watanuki | 381/330 |
| 2009/0092269 | A1 * | 4/2009 | Nielsen et al. | 381/313 |

FOREIGN PATENT DOCUMENTS

| | | | |
|---|---|---|---|
| EP | 1624720 | A2 | 2/2006 |
| WO | 2005/067654 | A2 | 7/2005 |
| WO | 2006/026988 | A1 | 3/2006 |
| WO | 2009/147370 | A1 | 12/2009 |

OTHER PUBLICATIONS

International Search Report for PCT/EP2009/055965 dated Feb. 10, 2010.
Written Opinion for PCT/EP2009/055965 dated Feb. 10, 2010.

* cited by examiner

*Primary Examiner* — Brian Ensey
(74) *Attorney, Agent, or Firm* — Pearne & Gordon LLP

(57) ABSTRACT

Within a casing of a hearing device to be worn in an area of an auricle such as behind an ear, comprises bendable portions such that the hearing device can be at least partially deformed.

21 Claims, 3 Drawing Sheets

BENDABLE HEARING DEVICE

The present invention refers to a hearing device according the introduction of claim 1.

Wearing comfort is one of the highest priority topics besides sounds quality and user interactions. As a consequence, it is an increasing requirement to hearing devices especially those to be worn at the auricle that a good comfort as well as a good appearance is achieved.

In addition, at sports activities it is important, a hearing device fits good at the auricle and does not fall off e.g. when a person is running.

One solution can be that the casing or shell of the hearing device is adjusted by an audiologist or fitter when the device is adapted to a user e.g. by using auxiliary fixing tools. Known out of the U.S. Pat. No. 6,022,311 is a soft-solid elastomer custom ear device into which electronics can be embedded for an optimised wearing comfort. In other words, today only in-the-ear hearing devices are custom made to reach an optimum wearing comfort. Hearing devices, to be worn at the auricle such as e.g. behind the ear (BTE) devices with standard ear hook and slim tube do not fit casually to all size of ears. In other words, at present behind the ear hearing instruments do not fit precisely to an individual ear and a result could be pressure points, the danger of falling off the ear and the visibility of a hearing instrument is not adequate which means, is not acceptable. Especially by using auxiliary fixing tools as mentioned above, could result in a very bad visual impression.

As mentioned all of todays behind the ear hearing devices have a standard shape, which is more or less like a banana. One can of course choose different sound delivery systems, but always the shape of the hearing instrument stays. Depending on the shape of the ear such BTE housings occurring pressure points and offer a bad wearing comfort or they are more visible from the side because the inner radius of the BTE does not fit to the back side ear radius of the ear.

It is therefore an object of the present invention to provide a hearing device to be worn at the auricle such as e.g. a behind the ear hearing instrument with which an improved wearing comfort and a better visible appearance can be achieved.

Accordingly the present invention proposes a hearing device according the wording of claim 1. The result of the present invention is a custom bendable hearing device such as a behind the ear hearing device, which can solve the above mentioned disadvantages.

According the present invention it is proposed that at or within the casing or shell of the hearing instrument bendable portions or areas are arranged such that the hearing device can be at least partially deformed.

According one embodiment the casing or shell comprises bendable or deformable areas, whereas according a further embodiment the areas are bendable or deformable upon the application of heat only.

According a further embodiment the casing or shell of the hearing device comprises areas which are rigid and in-between the rigid areas bendable or deformable areas are arranged preferably in an angle to the longitudinal dimension of the casing or shell. The bendable or deformable areas can be arranged in a laminar form.

The deformable or bendable areas can be made out of an at least under the influence of heat elastic material such as an elastic or elastomeric polymer. According one embodiment it is proposed to use an elastic polyether block-amide.

According a further embodiment the hearing device or instrument comprises a bendable inner skeleton such as e.g. a metal skeleton. On this bendable skeleton most or all of the hearing instrument system parts such as e.g. microphones, hybrids, battery modules, etc. can be fixed, which means can be assembled.

Again, according a further embodiment the casing or shell of the hearing instrument comprises raster portions, which means areas with integrated raster functionality. In that respect it is proposed that the hearing device such as e.g. a behind the ear hearing device comprises shells with different solid plastic parts, which can be moved by a fix way to each other, which mean that one part can be moved in respect to the next part by means of the above mentioned raster functionality.

Further, embodiments according the present invention are described within the claims such as e.g. the dependent claims.

Further, a process for the production of a hearing device according to one of the claims is proposed, whereas rigid and elastomeric materials such as polymer materials are injected by use of a 2K (2 component) technique into a mold to produce the rigid and elastic portions of the casing of the hearing instrument.

The invention is described in further details by way of examples, which are shown in the attached figures.

Figure 3:
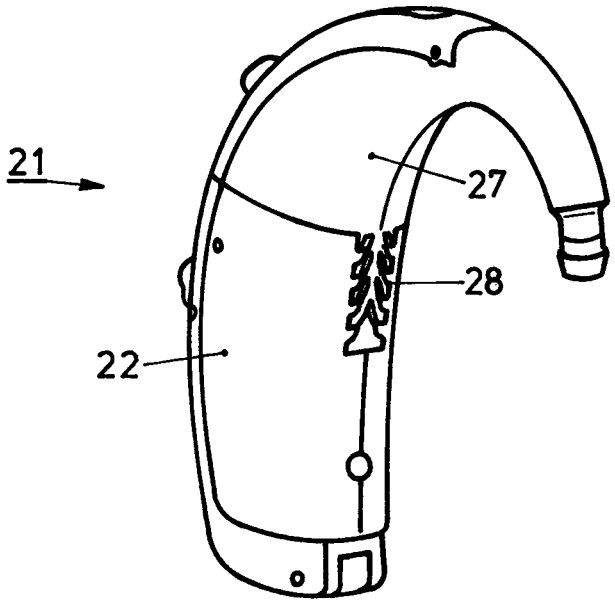

FIG. 3 finally shows a behind the ear shell with integrated raster functionality.

Figure 1:
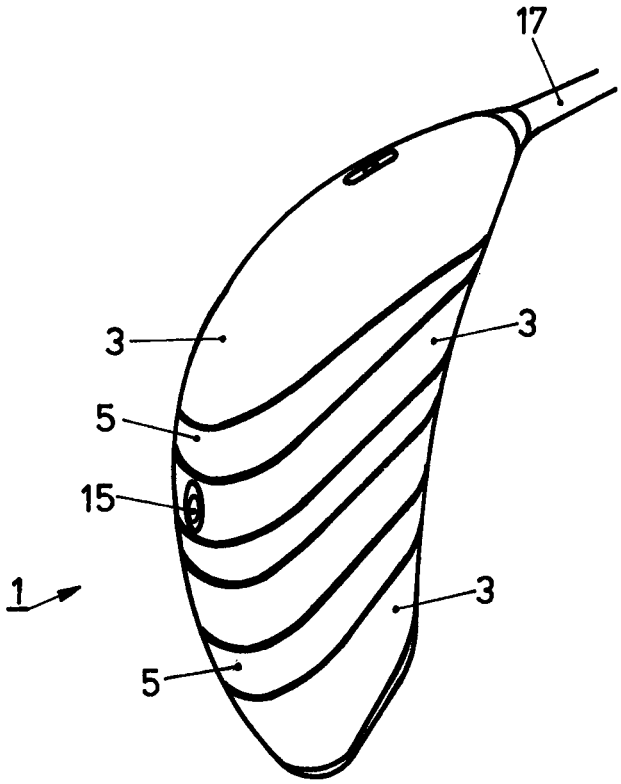
FIG. 1 shows a casing of a behind the ear hearing device comprising rigid and elastic areas.

FIG. 1 shows the casing or shell of a behind the ear hearing instrument 1, comprising rigid parts 3 and soft areas 5, which are arranged in a laminar form between the rigid part 3. The soft areas 5 offers the possibility of a certain bending movement of the casing 1, to adapt the casing e.g. for fitting the back side ear radius of the auricle of an ear of a user person. To guarantee a form fitting of the casing 1, it is proposed, to arrange a soft material within the soft areas 5, which gets its elastic properties while applying heat, which means with a heat source one can warm up these soft areas 5 and after cooling down to environment temperature the behind the ear shell 1 gets stiff in the desired shape.

The great advantage of only having soft properties when warming up the soft areas is that once the shape of the shell is achieved, the hearing device can be firmly arranged on the back side of an auricle of a users ear. But on any time the shape can be reformed by warming again the shell 1 of the hearing device.

A suitable material for the soft areas could be e.g. an elastic polyether block-amide, which is a thermoplastic elastomer made out of sequences consisting of polyamides and polyether segments. The great advantage of this polymer is that it has very good chemical resistance especially to perspiration and on the other side has a very good skin compatibility. As rigid portion e.g. a polyamide can be used, or any other kind of suitable polymer material, which can be processed e.g. in a so called 2 component injection technique process with the mentioned polyether block-amide, to produce the casing 1 as described with reference to FIG. 1.

Figure 2:
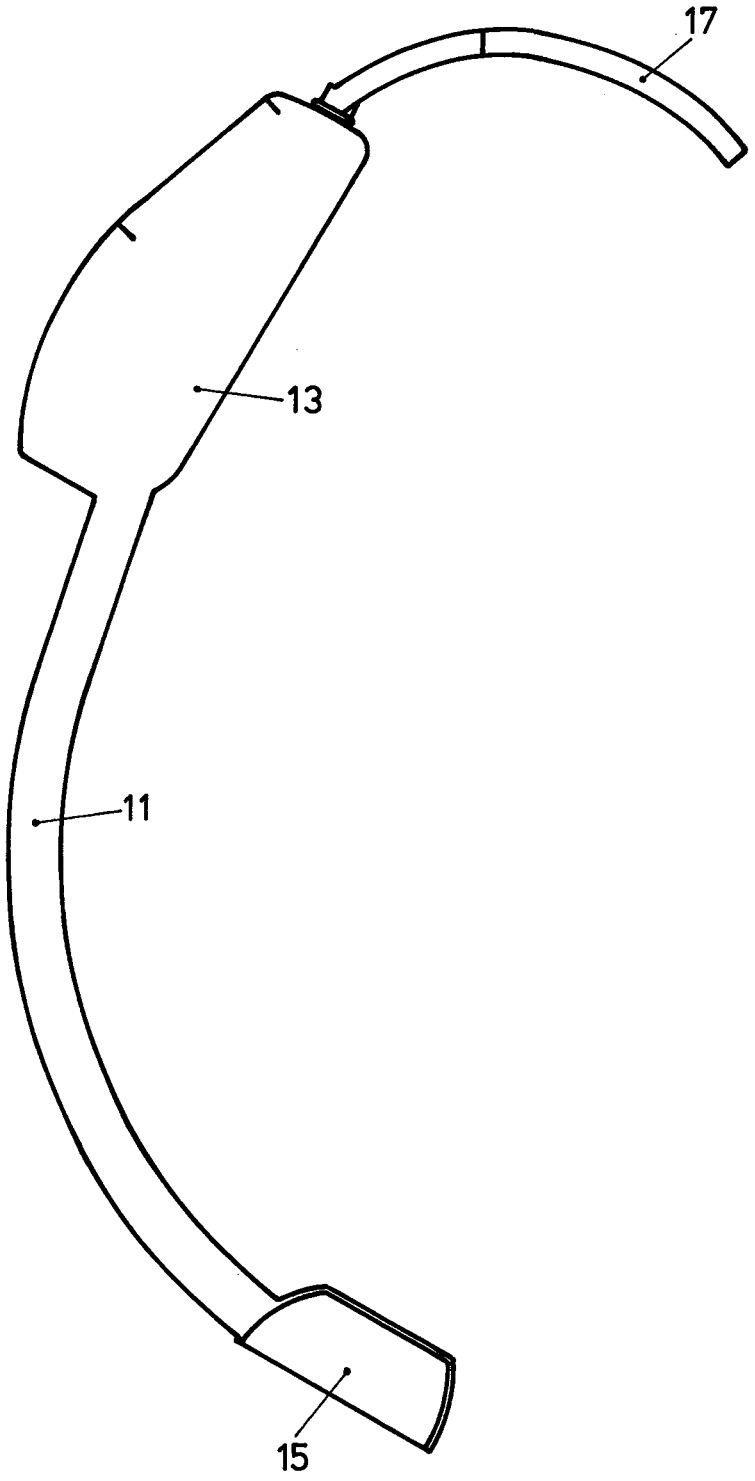
FIG. 2 shows an inner bendable skeleton structure of a behind the ear hearing device on which hearing instrument system parts are assembled.

In FIG. 2 an inside structure of a behind the ear hearing device is shown, consisting mainly of an inner bendable skeleton 11. On this skeleton, which could be e.g. a metal skeleton, the hearing instrument system parts such as e.g. a microphone 15, a switching circuit and battery module 13, can be assembled. Finally the interior structure can be connected to an acoustic tube 17 to connect the hearing device with the entrance of the ear canal.

Again, the great advantage of such an interior bendable structure is that once the shape is formed, it keeps the shape to guarantee a good fitting of the hearing instrument on the back side of an auricle of a users ear.

Again, a further possibility of a hearing device casing according the present invention is shown schematically with reference to FIG. 3. The casing 21 of the hearing instrument comprises a raster functionality, which can be achieved by using different solid parts to form the casing 21 of the hearing device. For instance on a main casing part 22 a covering additional casing part 27 can be arranged, which can be moved along a raster or grating portion 28 which connects the two shape parts 22 and 27.

Again, the advantage of the solution as proposed with respect to FIG. 3 is that once a shape of the casing 21 is achieved, it keeps the shape to guarantee a good fitting of the behind the ear hearing instrument on the back side of the auricle of a users ear. In addition, the stiffness or the bending properties of the casing can be influenced by using different additional casing covering parts 27, which additional parts can be completely stiff or can have a certain elasticity. As materials all kind of polymers can be used, which normally are used for hearing device shells or casings.

The invention has the great advantage that it can offer in an easy reliable way the possibility to have e.g. a behind the ear hearing instrument, which firmly fits to the back side ear radius of a user's ear. Furthermore, if the instrument is used by another person at any time adjustment of the shape of the hearing instrument casing is possible. The present invention in addition offers the possibility to sports people, to also use a hearing instrument during sports activities without the danger of falling off of the hearing device.

Besides the wearing comfort also an improvement regarding visibility of the hearing device can be achieved, as due to the form fitting of the hearing instrument device, the visibility can be optimised. Finally a great advantage also can be offered to hearing device instruments used by children.

The examples as shown within FIGS. 1 to 3 are examples for better explaining the present invention. It is self evident that the shown designs and proposals can be modified and that different materials can be used. For instance regarding FIG. 1, the soft areas do not have to be arranged in a laminar form, as e.g. the soft area could be arranged mainly on the surface of the casing, which is provided for abutting at the back side ear radius. In addition further elastomeric materials can be used, which have a required chemical resistance and which have a good compatibility to skin. Of course it is a certain advantage, if the elastomeric material has to be warmed up to get its elastic properties, while at room temperature it cannot be deformed.

In addition regarding FIG. 2 not a metal skeleton has to be used, as also e.g. polymer materials can be used, which have certain deformable characteristics such as the proposed metal.

The invention claimed is:

1. A hearing device to be worn in an area of an auricle, characterized in that at or within a casing or a shell, bendable portions or areas are arranged such that the hearing device can be at least partially deformed, wherein after the hearing device is at least partially deformed, the bendable portions or areas remain in the at least partially deformed shape in order to promote a proper fit of the hearing device within the auricle.

2. The hearing device according to claim 1, characterized in that the casing or the shell comprises bendable or deformable areas.

3. The hearing device according to claim 1, characterized in that the areas are bendable or deformable only upon application of heat.

4. The hearing device according to claim 2, characterized in that the casing or the shell comprising at least two rigid areas, and the bendable or deformable areas are arranged between the rigid areas.

5. The hearing device according to claim 2, characterized in that a plurality of the bendable or deformable areas are arranged between a plurality of rigid areas in a laminar form.

6. The hearing device according to claim 2, characterized in that the bendable or deformable areas are made at least under the influence of heat elastic polymer material such as an elastomeric polymer.

7. The hearing device according to claim 2, characterized in that the bendable or deformable portions or areas are made out of an elastic polyether block-amide.

8. The hearing device according to claim 1, characterized in that the hearing device comprises an inner bendable skeleton, on which the hearing instrument system parts can be arranged or assembled, wherein the skeleton retains its shape after a desired shape is formed.

9. The hearing device according to claim 8, characterized in that the bendable skeleton is a metal skeleton.

10. The hearing device according to claim 1, characterized in that the casing or the shell comprises raster portions integrated in a wall of the casing or the shell.

11. The hearing device according to claim 10, characterized in that the casing or the shell consists of different at least solid plastic parts, which can be moved incrementally with respect to each other, along a raster or grating area.

12. Process to produce the hearing device according to claim 1, characterized in that the casing or the shell of the device, comprising rigid and elastic portions, is produced by injecting rigid and elastomeric polymer materials by use of two component injection molding technique.

13. The hearing device according to claim 4, wherein the bendable or deformable areas are arranged in an angle to a longitudinal dimension of the casing.

14. Process to produce the hearing device according to claim 2, characterized in that the casing or the shell of the device, comprising rigid and elastic portions, is produced by injecting rigid and elastomeric polymer materials by use of two component injection molding technique.

15. Process to produce the hearing device according to claim 3, characterized in that the casing or the shell of the device, comprising rigid and elastic portions, is produced by injecting rigid and elastomeric polymer materials by use of two component injection molding technique.

16. Process to produce the hearing device according to claim 4, characterized in that the casing or the shell of the device, comprising rigid and elastic portions, is produced by injecting rigid and elastomeric polymer materials by use of two component injection molding technique.

17. Process to produce the hearing device according to claim 5, characterized in that the casing or the shell of the device, comprising rigid and elastic portions, is produced by injecting rigid and elastomeric polymer materials by use of two component injection molding technique.

18. Process to produce the hearing device according to claim 6, characterized in that the casing or the shell of the device, comprising rigid and elastic portions, is produced by injecting rigid and elastomeric polymer materials by use of two component injection molding technique.

19. Process to produce the hearing device according to claim 7, characterized in that the casing or the shell of the device, comprising rigid and elastic portions, is produced by injecting rigid and elastomeric polymer materials by use of two component injection molding technique.

20. The hearing device according to claim 1, characterized in that the hearing device comprises a behind the ear device.

21. The hearing device according to claim 1, wherein after the hearing device is at least partially deformed, the bendable portions or areas remain in the at least partially deformed shape without application of any force in order to promote a proper fit of the hearing device within the auricle.

* * * * *